US007914316B2

(12) United States Patent
D'Addario et al.

(10) Patent No.: US 7,914,316 B2
(45) Date of Patent: Mar. 29, 2011

(54) LOCK ATTACHMENT FOR AUDIO-VISUAL CONNECTOR

(75) Inventors: James D'Addario, Old Westbury, NY (US); Robert O. Miller, Deer Park, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 12/798,534

(22) Filed: Apr. 6, 2010

(65) Prior Publication Data

US 2011/0053407 A1 Mar. 3, 2011

Related U.S. Application Data

(60) Provisional application No. 61/275,417, filed on Aug. 28, 2009.

(51) Int. Cl.
*H01R 13/627* (2006.01)

(52) U.S. Cl. ..... 439/362; 439/364; 439/373

(58) Field of Classification Search ..... 439/362, 439/364, 373
See application file for complete search history.

(56) References Cited

U.S. PATENT DOCUMENTS

| | | | | |
|---|---|---|---|---|
| 3,487,353 | A | 12/1969 | Massa | 339/89 |
| 6,522,532 | B2 | 2/2003 | Liao et al. | 361/686 |
| 6,554,635 | B2 | 4/2003 | Ayers et al. | 439/362 |
| 6,908,344 | B1 | 6/2005 | Ahmed et al. | 439/677 |
| 7,134,899 | B1 * | 11/2006 | Huang | 439/352 |
| 7,214,087 | B2 | 5/2007 | Kuo | 439/364 |
| 7,749,015 | B2 * | 7/2010 | Uchikawa et al. | 439/362 |
| 2003/0045154 | A1 | 3/2003 | Ayers et al. | 439/362 |
| 2009/0280674 | A1 * | 11/2009 | Eppright et al. | 439/373 |
| 2010/0190371 | A1 | 7/2010 | Luu | 439/320 |

* cited by examiner

*Primary Examiner* — Tho D Ta
(74) *Attorney, Agent, or Firm* — Alix, Yale & Ristas, LLP

(57) ABSTRACT

The combination of an electronic connector plug and an attached locking clip, wherein the connector comprises a cable, a plug housing surrounding one end of the cable, and a plug supported in the housing, such that the plug extends from the front of the housing and is electrically connected through the housing to the cable. The clip surrounds the housing and can be locked onto an electrical component by a lock screw such that the advancing screw also urges a clamp against the housing thereby securing the plug into the jack of the component. The electrical component is preferably an audio-visual (AV) device having an HDMI socket.

16 Claims, 7 Drawing Sheets

LOCK ATTACHMENT FOR AUDIO-VISUAL CONNECTOR

This is a regular application claiming the benefit under 35 U.S.C. 119(e) of U.S. Provisional App. No. 61/275,417 filed Aug. 28, 2009 for "Lock Attachment for Audio-Visual Connector".

BACKGROUND

With the advent of HD TV, the HDMI (High-Definition Multimedia Interface) connector is now in common use as a compact audio/video interface for transmitting uncompressed digital data. This connector is having increased use as a means of digital interconnection between consumer electronics products such as digital audio/video (AV) sources to compatible system components such as digital audio devices, computer monitors, and digital televisions.

Conventional HDMI connectors (FIG. 1) lack an effective locking feature to hold the connector plug into a socket. As a result of this deficiency, plugs can easily slip out of sockets.

This is a significant problem in the custom home theater, audio, video and residential electronic systems installation industry. The cables are heavy and the lack of effective locking features robust enough to keep the standard plug in place may result in a plug becoming dislodged from its socket. Disconnection of the HDMI interface is a very common occurrence and results in total loss of video and audio. Most HDMI connectors are of the conventional type, and the problem of disconnect is prevalent in both the currently installed and future user base.

Recently, a number of HDMI equipment manufacturers have added a threaded screw receptacle R above the HDMI socket, as shown in FIG. 2. With the addition of this threaded receptacle feature, specialty HDMI cables that feature connectors with an integrated locking screw mechanism S may be used to secure the plug to the socket (see FIG. 3).

SUMMARY

In one aspect, the present invention is directed to a clip that slips over a standard HDMI connector, and imparts a locking feature that is functionally similar to the locked plug shown in FIG. 3.

In another aspect, the invention is directed to the combination of a locking clip attached to a standard connector of the type shown in FIG. 1, thereby providing a functionality similar to the plug with integrated lock as shown in FIG. 3.

In a broader aspect the invention is directed to a locking clip for any type of electronic connector, comprising an elongated base having a through bore, a substantially tubular sleeve having sidewalls extending downwardly from the base and defining a hollow space having a longitudinal axis, and a clamp cantilevered from the base and including a substantially tubular collar substantially coaxially aligned with the tubular sleeve. A locking screw is insertable in the through bore, having a threaded front end and a shoulder spaced rearward and adapted to engage and push on the base.

Preferably, the through bore includes a socket at the front end, a mounting screw having a nut portion insertable in the socket and a threaded front end extending in front of the base, whereby the front end of the locking screw engages the nut of the mounting screw when the shoulder of the locking screw engages the base.

In another broad aspect, the invention is directed to the combination of an electronic connector plug and an attached locking clip, wherein the connector comprises a cable, a plug housing surrounding one end of the cable, and a plug supported in the housing, such that the plug extends from the front of the housing and is electrically connected through the housing to the cable. The clip surrounds the housing and can be locked onto an electrical component by a lock screw such that the advancing screw also urges a clamp against the housing thereby securing the plug into the jack of the component. The electrical component is preferably an audio-visual (AV) device having an HDMI socket.

Preferably, the back end of the housing forms a thrust shoulder with the cable and the locking clip at least partially surrounds the housing. The clip includes a base with a through bore offset from and parallel with the extension of the plug. The base has a back end that defines another thrust shoulder. A clamp extends rearward beyond the back of the housing and has a clamp shoulder confronting the thrust shoulder of the housing. The locking screw is insertable in the through bore, having a threaded front end and a screw shoulder spaced rearward of and adapted to engage and push on the thrust surface of the base when the locking screw is advanced directly or indirectly into a threaded receiving bore in an AV component facing the front of the housing, thereby also positioning or urging the clamp shoulder at or against the thrust shoulder of the housing.

The clamp is preferably a circular but open collar that snaps over the cable and rests against or bears on the back of the connector housing, preventing unintentional disconnection of the connector once the locking screw is connected to the AV component.

DETAILED DESCRIPTION

Figure 4:
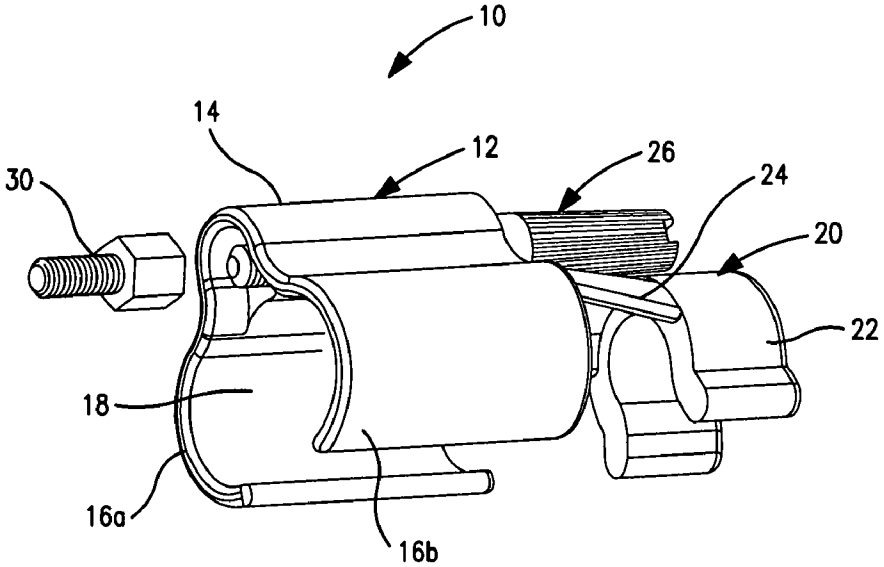
FIG. 4 is an oblique side view of a clip embodiment of the present invention, for use with a conventional HDMI cable and plug such as shown in FIG. 1.
Figure 6:
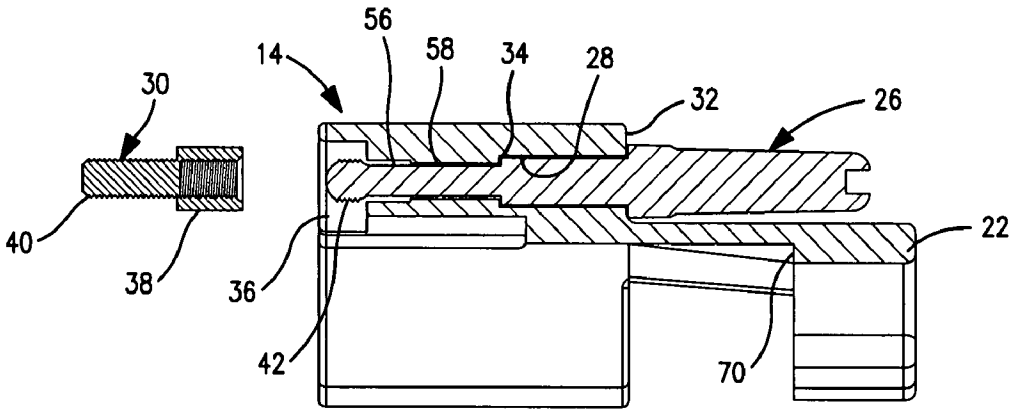
FIG. 6 is a longitudinal section view similar to FIG. 5, with the locking screw in the clip.
Figure 5:
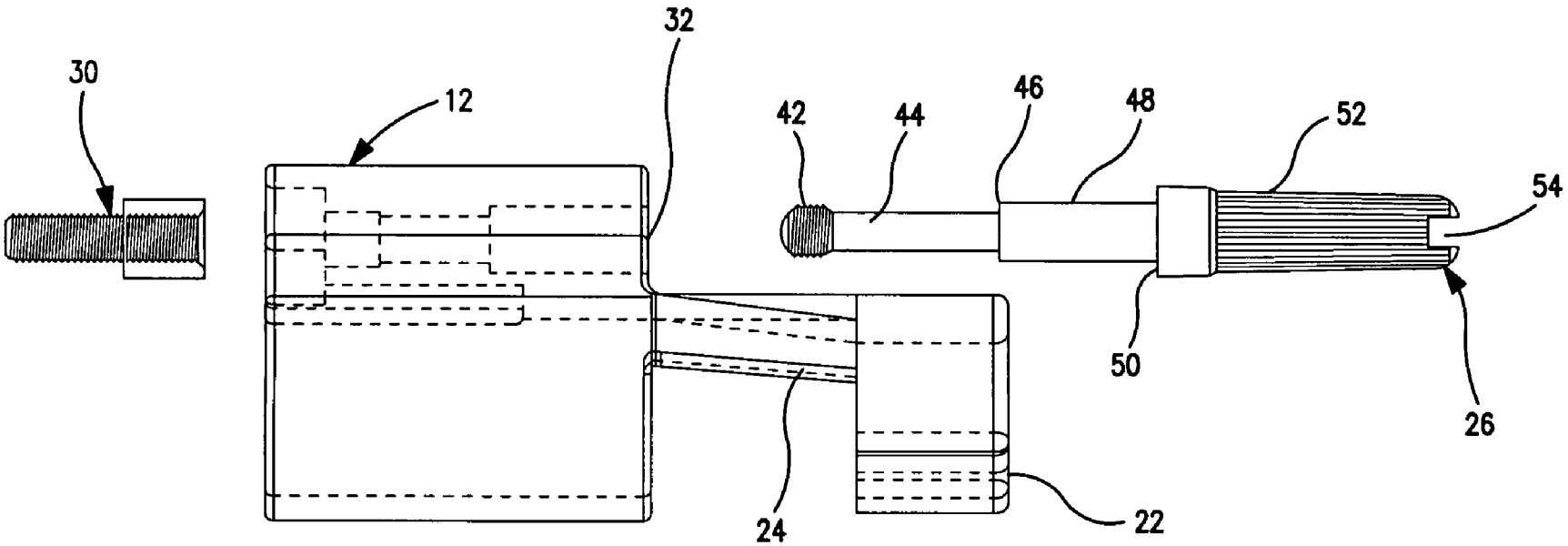
FIG. 5 is a side view of the clip of FIG. 5, with the mounting and locking screws withdrawn for clarity.

FIGS. 4-6 show an embodiment of a locking clip assembly, having the basic elements of a clip 12 comprising an elongated base 14, a substantially tubular sleeve having sidewalls 16*a*, 16*b* extending downwardly from the base and defining a hollow space 18 having a longitudinal axis, and a clamp 20 extending from the base and including a substantially tubular collar 22 substantially coaxially aligned with the tubular sleeve. In the intended usage, the base 14 will be at the top, with the two half-sleeves 16*a*, 16*b* having sufficient flexibility radially of the axis, to permit the sleeve to deformably slip over and then return to engage the housing of the AV connector, which will be further described below. Likewise, the clamp, in this case the collar 22, is similarly a substantial cylinder except for an open slot at the bottom, which permits the collar to be slid over the cable with or without deformation.

Preferably, the clamp 20 is cantilevered, as by a downwardly inclined web 24, from the base 14, but exact coaxial alignment between the sleeve 16 and the collar 22 is not necessary at all times when the clip is attached to the cable and connector, because some accommodation can be afforded by the inherent flexibility of the web 24.

Figure 1:
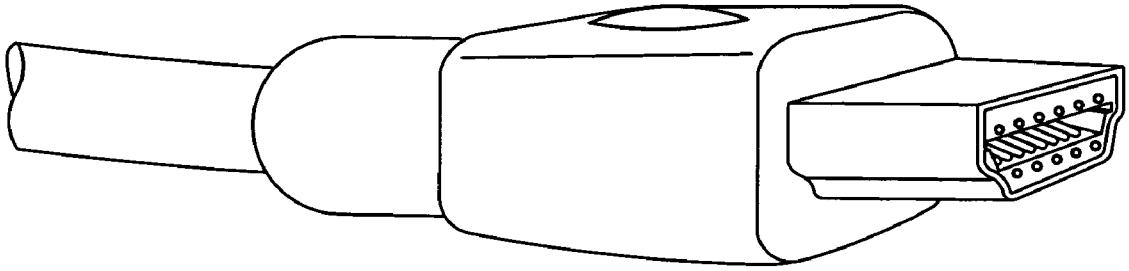
FIG. 1 PRIOR ART
FIG. 1 is an oblique end view of a conventional HDMI cable and connector plug.
Figure 2:
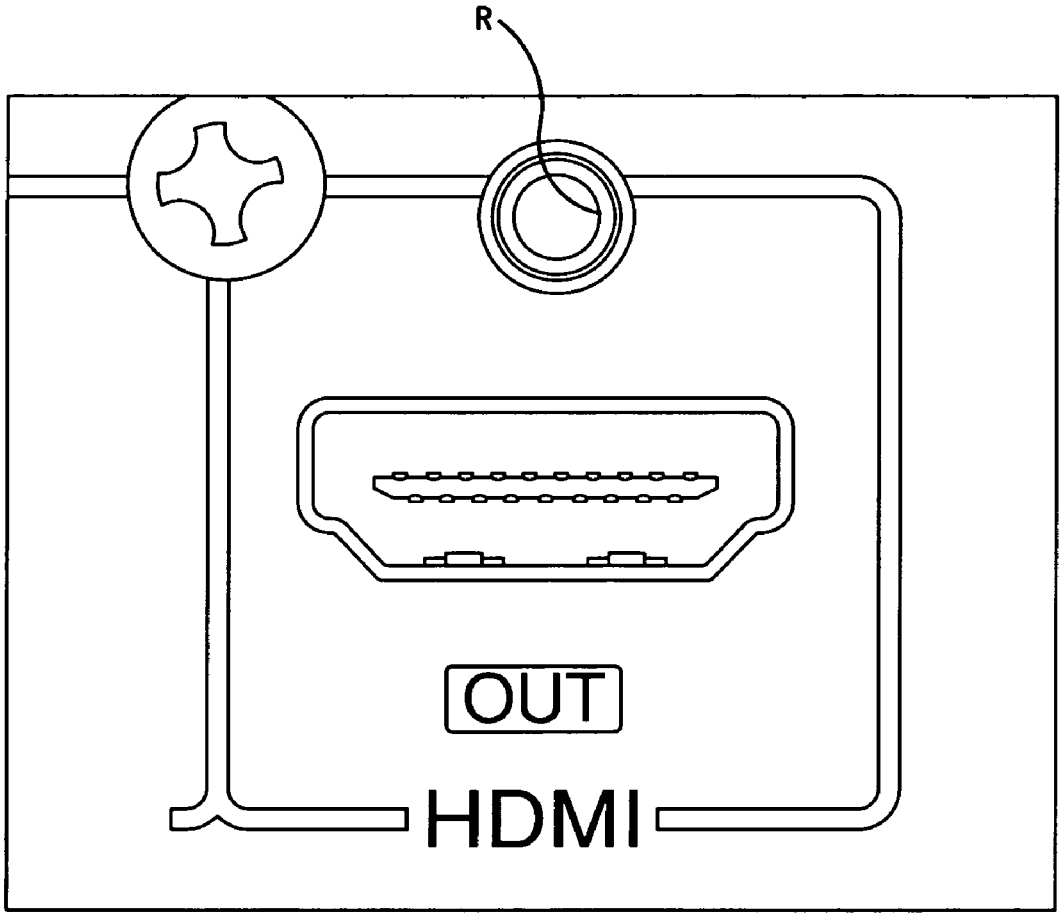
FIG. 2 PRIOR ART
FIG. 2 is a view of a conventional HDMI jack on an AV component, with an optional adjacent threaded bore for receiving and locking an HDMI plug with integrated locking boss and screw.
Figure 3:
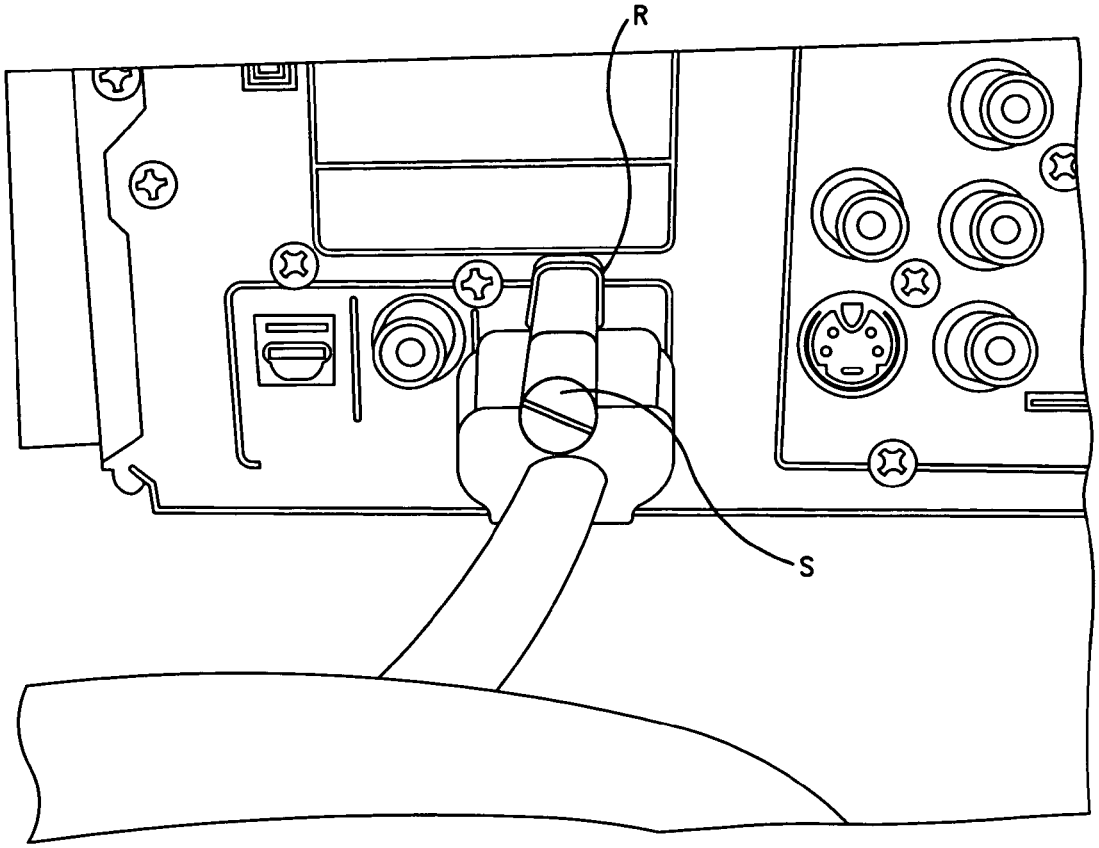
FIG. 3 PRIOR ART
FIG. 3 is a view similar to FIG. 2, showing an HDMI plug with integrated locking boss, secured to the HDMI jack.

In use, a thumbscrew 26 extends into a through bore 28 of the base, whereby the threaded tip of the thumbscrew directly or indirectly engages a threaded receptacle above the HDMI socket in the AV component (as shown in FIG. 2). Although a single thumbscrew 26 can be used for this purpose, it is preferred that a separate mounting screw 30 be threaded into the receptacle on the AV component, and that the thumbscrew 26 be advanced into the mounting screw 30. The base 14 has a back side which presents an external shoulder 32 around the through bore 28 and an internal shoulder 34 in the through bore. At the front of the base 14, a socket 36 has an internal profile adapted to receive the external profile 38 of the mounting screw 30. The externally threaded screw portion 40 of the mounting screw 30 can be threaded into the receptacle on the AV component, whereas the threaded front or nose portion 42 of the thumbscrew can be threaded into the internal threads of the nut portion 38. The thumbscrew typically has a first shank portion 44 extending rearward from the threaded nose 42, a first shoulder 46 associated with a second shank portion 48, and a second shoulder 50 at the front of the enlarged thumb knob 52. Preferably, the back end of the thumbscrew includes a slot 54 by which a tool can further tighten or loosen the thumbscrew. The thumbscrew is similar to conventional thumbscrews used with AV equipment.

Preferably, the relationships of the dimensions are such that when the thumbscrew 26 is advanced within the through bore 28, the shoulder 50 bears against the thrust surface provided by external shoulder 32 after the nose 42 has been advanced well into the nut 38, but before hitting a limit position within the nut.

With further reference to FIG. 6 in particular, it may be seen that the through bore 28 has a relatively larger diameter portion 56 immediately adjacent the socket 36, and an adjacent, relatively smaller diameter portion 58, thereby forming an internal shoulder. In this manner, the thumbscrew 26 can be pulled back with the threads 42 withdrawn into the larger diameter bore portion 56 while stopped at the shoulder with bore portion 58 during the initial engagement of the connector and clip with the AV component socket and the nut portion 38 of the installed mounting screw 30, respectively.

Figure 7:
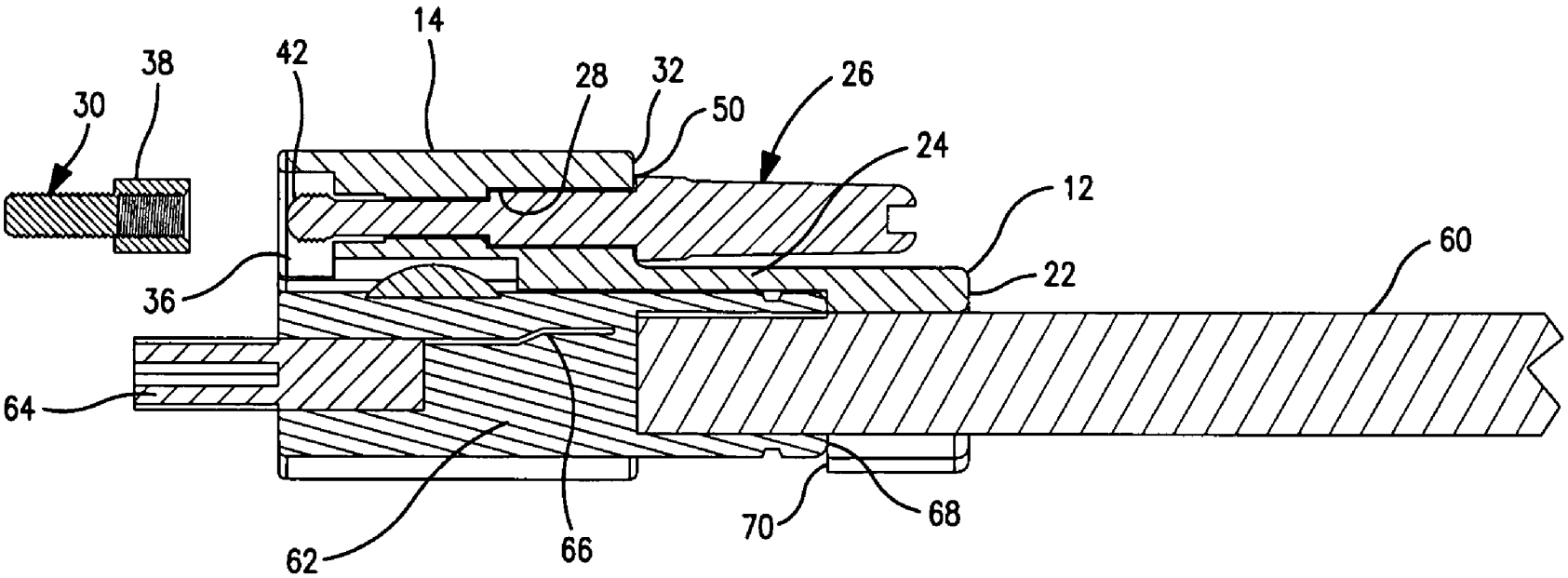
FIG. 7 is longitudinal section view of the assembled cable, plug, and clip.

FIG. 7 is a cross-section view of the combination of clip assembly and connector assembly. The connector assembly comprises a cable 60, a plug housing or shell 62 surrounding one end of the cable, and a plug 64 supported in the housing such that the plug extends from the front of the housing and is electrically connected, such as via conductor 66, through the housing to a conductor in the cable. The back end 68 of the housing forms a shoulder relative to the diameter of the cable 60. The base 14 of the clip 12 has a rearwardly extending clamp including collar 22 which surrounds at least some of the cable 60 and has an internal shoulder 70 which abuts the shoulder 68 at the back of the housing.

As previously described, with the mounting screw 30 already installed in the AV component and the thumbscrew 26 withdrawn so that the threads 42 are in the region 56 of the bore (see FIG. 6), the assembly as shown in FIG. 7 is advanced into the socket of the AV component such that the plug portion 64 is fully within the socket and the nut portion 38 of the mounting screw 30 is captured within the profile of the recess 36 at the front of the clip. The thumbscrew is then advanced such that the threads 42 engage the internal threads of the nut 38 and eventually cause the shoulder 50 on the thumbscrew to bear against the thrust surface 32 of the base 14 which in turn urges the collar 22 against another thrust surface provided by the shoulder 70. This secures the entire assembly into the AV component.

Figure 8:
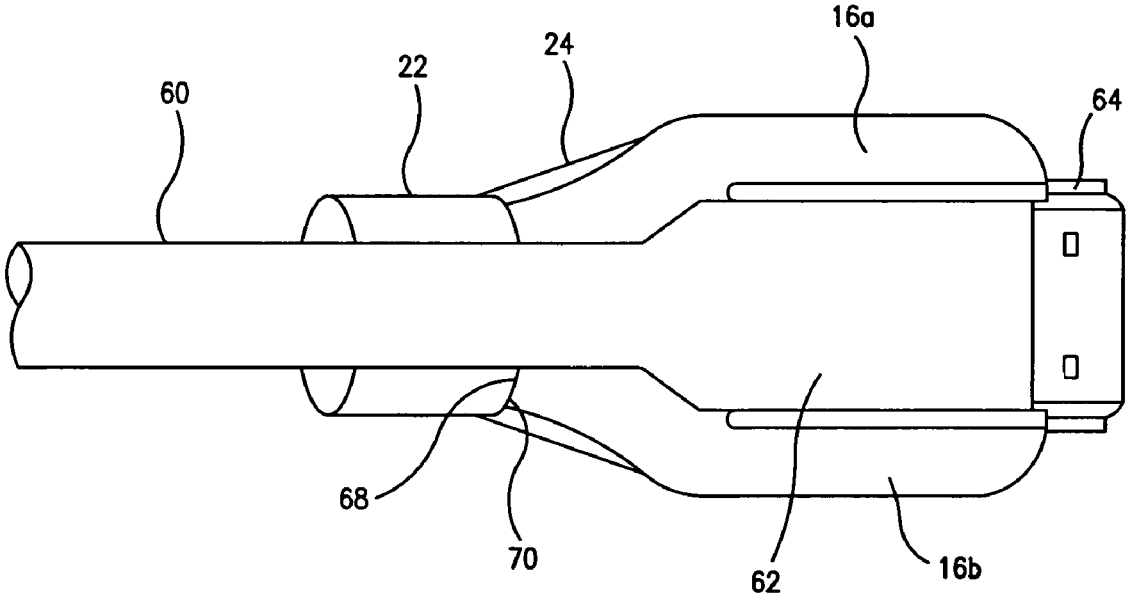
FIG. 8 is a bottom view of the assembled cable, plug, and clip according to FIG. 7.

FIG. 8 illustrates the condition shown in FIG. 7 where the half-sleeves surround the housing and the collar surrounds the cable around at least about 180° span, such that the collar is positioned to engage or provide a stop surface at the back shoulder of the housing.

It should be appreciated that although the invention has been described with respect to HDMI plug connectors, the inventive concept is applicable to all types of AV connectors.

The invention claimed is:

1. An electronic signal connector comprising in combination:

a connector assembly including a cable, a plug housing surrounding one end of the cable and having a front and a back, wherein the back of the housing forms a housing thrust shoulder with the cable, and a plug supported in the housing, such that the plug extends from the front of the housing and is electrically connected through the housing to the cable; and a locking clip at least partially surrounding the housing, and including a base with through bore offset from and parallel with the extension of the plug, wherein said base has a front end and a back, wherein the back end defines a clip thrust shoulder and a clamp extends rearward beyond the back of the housing and has a shoulder confronting the housing thrust shoulder, wherein the clamp includes a collar spaced behind the base and cantilevered from the base and the shoulder of the clamp is on said collar.

2. The connector of claim 1, wherein the collar is cantilevered from the base with an angled, flexible web.

3. The connector of claim 1, wherein the connector is an audio-visual signal connector.

4. The connector of claim 1, including a locking screw that can be advanced in the through bore, having a threaded front end and a shoulder spaced rearward from and adapted to engage and push on the clip thrust surface when the locking screw is advanced into a threaded receiving bore in an electronics component facing the front of the housing, thereby also urging the shoulder of the clamp against the housing thrust shoulder.

5. The connector of claim 4, wherein the plug is an HDMI plug.

6. The connector of claim 4, wherein:

a substantially tubular sleeve having sidewalls extends downwardly from the base and partially surrounds the housing; and the collar is substantially tubular and substantially coaxially aligned with the tubular sleeve.

7. The connector of claim 6, wherein the sleeve and the collar are deformable expandable about the axis.

8. The connector of claim 6, wherein the plug is an HDMI plug.

9. The connector of claim 1, including a locking screw that can be advanced in the through bore, having a threaded front end and a shoulder spaced rearward of and adapted to engage and push on the clip thrust surface.

10. The connector of claim 9, wherein the through bore includes a socket at the front end of the base;

a mounting screw has a nut portion insertable in the socket and a threaded front end projecting from the front end of the base; and the front end of the locking screw engages the nut of the mounting screw when the shoulder of the locking screw engages the clip thrust surface.

11. An electronic signal connector comprising in combination:

a connector assembly including a cable, a plug housing surrounding one end of the cable and having a front and a back, wherein the back of the housing forms a housing thrust shoulder with the cable, and a plug supported in the housing, such that the plug extends from the front of the housing and is electrically connected through the housing to the cable;

a locking clip at least partially surrounding the housing, and including a base with through bore offset from and parallel with the extension of the plug, wherein said base has a front end and a back, wherein the back end defines a clip thrust shoulder and a clamp extends rearward beyond the back of the housing and has a shoulder confronting the housing thrust shoulder;

a locking screw that can be advanced in the through bore, having a threaded front end and a shoulder spaced rearward of and adapted to engage and push on the clip thrust surface; wherein the through bore includes a socket at the front end of the base;

a mounting screw has a nut portion insertable in the socket and a threaded front end projecting from the front end of the base;

the front end of the locking screw engages the nut of the mounting screw when the shoulder of the locking screw engages the clip thrust surface; and the clamp includes a substantially tubular collar defining the shoulder of the clamp and the collar is spaced behind the base and cantilevered from the base with an angled, flexible web.

12. The locking clip of claim 11, wherein the sleeve and the collar are deformably expandable about the axis.

13. The locking clip of claim 11, including a locking screw insertable in the through bore, having a threaded front end and a shoulder spaced rearward and adapted to engage and push on the thrust surface of the base.

14. The locking clip of claim 13, wherein the through bore includes a socket at the front end;

a mounting screw has a nut portion insertable in the socket and a threaded front end extending in front of the base; and the front end of the locking screw engages the nut of the mounting screw when the shoulder of the locking screw engages the thrust surface of the base.

15. A locking clip for an electronic connector, comprising:

an elongated base having front and back ends with a through bore and a thrust surface around the through bore at the back end;

a substantially tubular sleeve having sidewalls extending downwardly from the base and defining a hollow space having a longitudinal axis; and a clamp extending from the base and including a substantially tubular collar substantially coaxially aligned with the tubular sleeve;

wherein the collar is spaced behind the base and cantilevered from the base with an angled, flexible web.

16. The locking clip of claim 15, wherein the sleeve and the collar are expandable about the axis;

a locking screw is captured in the through bore, having a threaded front end and a shoulder spaced rearward and adapted to engage and push on the thrust surface of the base;

the through bore includes a socket at the front end;

a mounting screw has a nut portion insertable in the socket and a threaded front end extending in front of the base; and the front end of the locking screw engages the nut of the mounting screw when the shoulder of the locking screw engages the thrust surface of the base.

* * * * *